US012226029B2

(12) United States Patent
Piretti

(10) Patent No.: US 12,226,029 B2
(45) Date of Patent: Feb. 18, 2025

(54) CHAIR WITH A TILTING BACKREST

(71) Applicant: Pro-Cord S.p.A., Bologna (IT)

(72) Inventor: Giancarlo Piretti, Bologna (IT)

(73) Assignee: Pro-Cord S.p.A., Bologna (IT)

( * ) Notice: Subject to any disclaimer, the term of this patent is extended or adjusted under 35 U.S.C. 154(b) by 52 days.

(21) Appl. No.: 18/179,453

(22) Filed: Mar. 7, 2023

(65) Prior Publication Data

US 2023/0284784 A1 Sep. 14, 2023

(30) Foreign Application Priority Data

Mar. 9, 2022 (IT) ..... 102022000004454

(51) Int. Cl.
*A47C 7/44* (2006.01)

(52) U.S. Cl.
CPC ..... *A47C 7/44* (2013.01)

(58) Field of Classification Search
CPC ..... A47C 7/44
USPC ..... 297/285, 286, 287, 288, 289, 290, 291, 297/292, 293, 300.1, 300.2, 300.3, 300.4, 297/300.5, 300.6, 300.7, 300.8
See application file for complete search history.

(56) References Cited

U.S. PATENT DOCUMENTS 117,915 A 8/1871 Morrison
4,372,609 A 2/1983 Boisset
4,383,714 A * 5/1983 Ishida ..... A47C 3/03 297/261.3
5,577,802 A * 11/1996 Cowan ..... A47C 3/0257 297/303.2
7,497,515 B2 * 3/2009 Krehm ..... A47C 7/443 297/303.2
8,662,586 B2 * 3/2014 Serber ..... A47C 3/0257 297/316
10,231,546 B2 * 3/2019 Loew ..... A47C 3/22
10,743,667 B2 * 8/2020 Loew ..... A47C 3/22
2013/0221719 A1 * 8/2013 Costaglia ..... A47C 1/03255 297/340
2016/0192782 A1 * 7/2016 He ..... A47C 7/443 297/285

FOREIGN PATENT DOCUMENTS

EP 2517606 A1 10/2012
WO 0171527 A2 9/2001

OTHER PUBLICATIONS

Search Report dated Oct. 12, 2022. 8 pages.

* cited by examiner

*Primary Examiner* — Rodney B White
(74) *Attorney, Agent, or Firm* — RMCK Law Group PLC

(57) ABSTRACT

A chair includes a base structure, a seat carried by the base structure, and a backrest movable relative to the seat between a rest position and a rearward inclined position, wherein the backrest has a connecting portion having a front surface and a rear surface, and wherein the seat has first and second guide surfaces which guide, respectively, the front surface and the rear surface of the connecting portion of the backrest.

9 Claims, 9 Drawing Sheets

CHAIR WITH A TILTING BACKREST

CROSS-REFERENCE TO RELATED APPLICATION

This application claims priority to Italian Patent Application No. 102022000004454 filed Mar. 9, 2022. The disclosure of the above application is incorporated herein by reference in its entirety.

FIELD OF THE INVENTION

The present invention relates to a chair with a tilting backrest.

More precisely, the invention relates to a chair comprising a backrest connected to the seat by means of a device which allows movement of the backrest between a rest position and a rearward inclined position under a backward thrust applied by the user, and the elastic return of the backrest into the rest position when the backward thrust applied by the user's back ceases.

DESCRIPTION OF THE PRIOR ART

In the state of the art many solutions are known for obtaining a rearward tilting movement of the backrest under a backward thrust applied by the user.

For example, the document EP-A-1557115 by the same applicant describes a chair with a tilting backrest connected to the base structure by means of elastically yielding lateral connecting elements to allow a rearward tilt of the backrest.

Another known solution is described in the document EP-A-2183997, in which the backrest is connected to the base structure by means of two elastic devices, each of which is formed by an elastic element deformable under bending and inserted inside a plurality of stacked sectors.

One of the problems of the known solutions is that the rotation center of the backrest during the backward tilting movement does not coincide with the rotation center of the user's back. This means that during the backward tilting movement of the backrest there is a relative movement between the resting surface of the backrest and the user's back. This relative movement tends to cause the garments to slip off. For example, if the user wears a shirt tucked into his trousers, in certain known types of chairs the backward tilting movement of the backrest tends to slip the shirt out of the trousers.

EP-A-2517606 by the same Applicant describes a chair comprising a base structure carrying a seat, a tilting backrest, and a pair of joints that connect the backrest to the base structure and that allow a backward tilting movement of the backrest, wherein each of said joints comprises a first and a second curved element with a circular profile coupled to each other in a telescopic manner.

OBJECT AND SUMMARY OF THE INVENTION

The object of the present invention is to provide a chair with a tilting backrest equipped with a backrest backward tilting mechanism that is simpler, lighter and with a smaller number of components than known solutions.

According to the present invention, this object is achieved by a chair having the characteristics forming the subject of claim 1.

Preferred embodiments form the subject of the dependent claims.

The claims form an integral part of the disclosure provided here in relation to the invention.

BRIEF DESCRIPTION OF THE DRAWINGS

The present invention will now be described in detail with reference to the attached drawings, given purely by way of non-limiting example, in which.

It will be appreciated that the various figures may not be represented on the same scale. It will also be appreciated that some elements or components may not be illustrated to make other elements/components more visible and to simplify the understanding of the figures.

DETAILED DESCRIPTION

Figure 1:
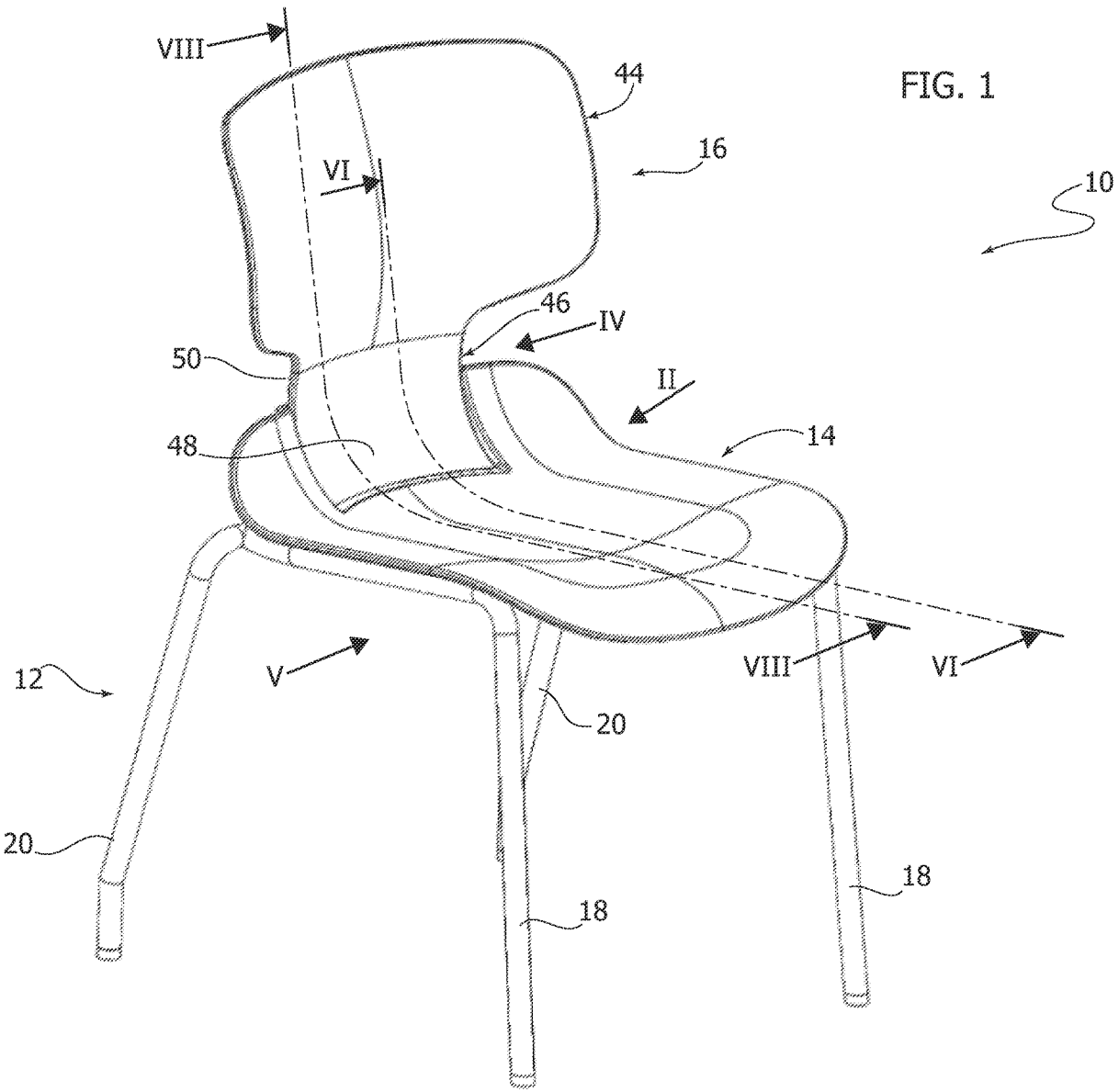
FIG. 1 is a perspective view of a chair according to the present invention.

With reference to FIG. 1, numeral 10 designates a chair according to the present invention. The chair 10 comprises a base structure 12, a seat 14 and a backrest 16.

In the illustrated example, the base structure 12 comprises two front legs 18 and two rear legs 20 connected to each other by longitudinal and transverse elements. However, the present invention is not limited to chairs with a base structure of this type. The invention could also be used on office chairs wherein the base structure comprises an upper element that rotates around a vertical axis carrying the seat and the backrest.

The seat 14 may be formed from a single shaped panel of plastic material, for example, injection molded. The seat 14 may be fixed to the base structure 12 by means of screws or other fixing systems.

Figure 2:
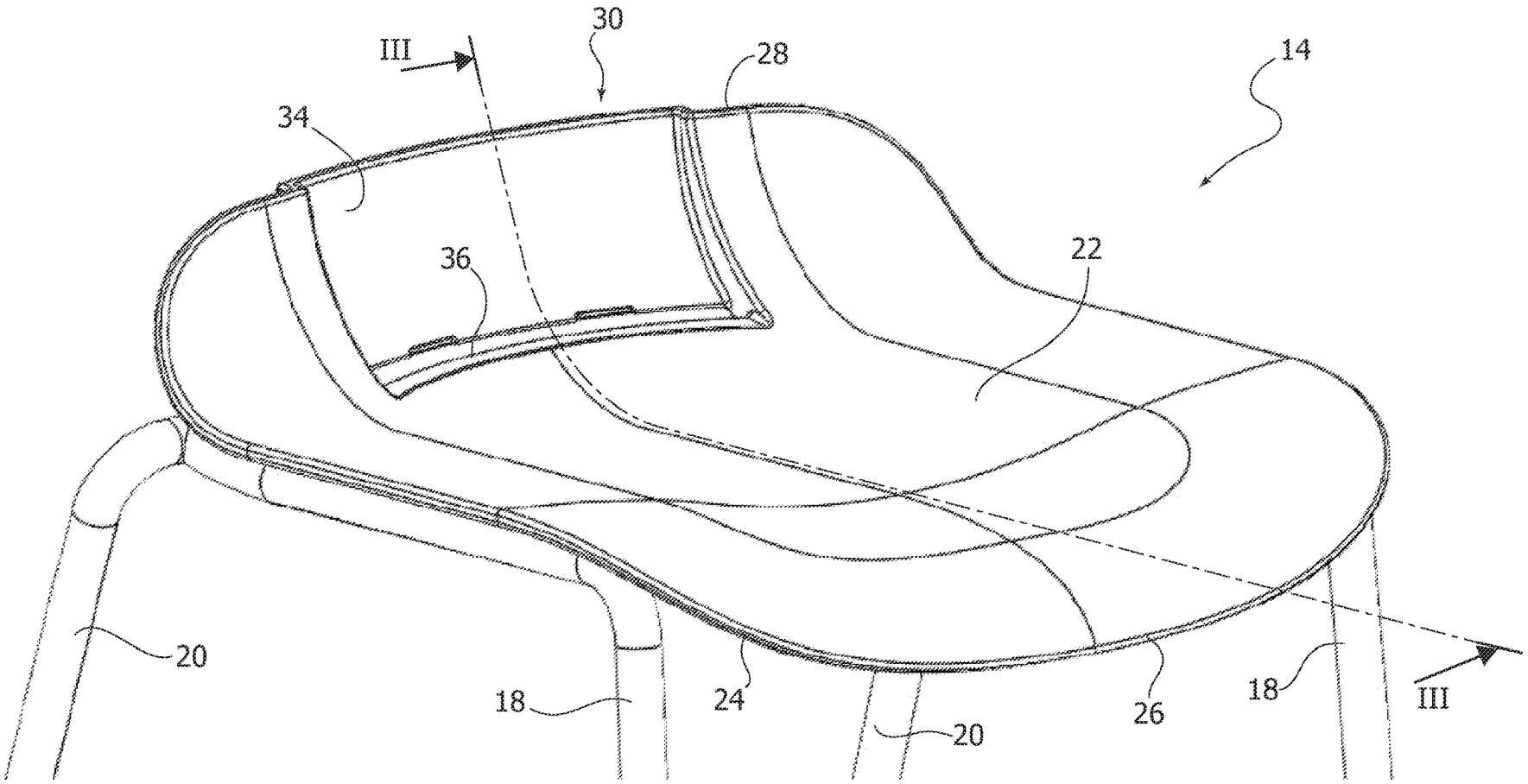
FIG. 2 is a perspective view of the seat indicated by the arrow II in FIG. 1.
Figure 3:
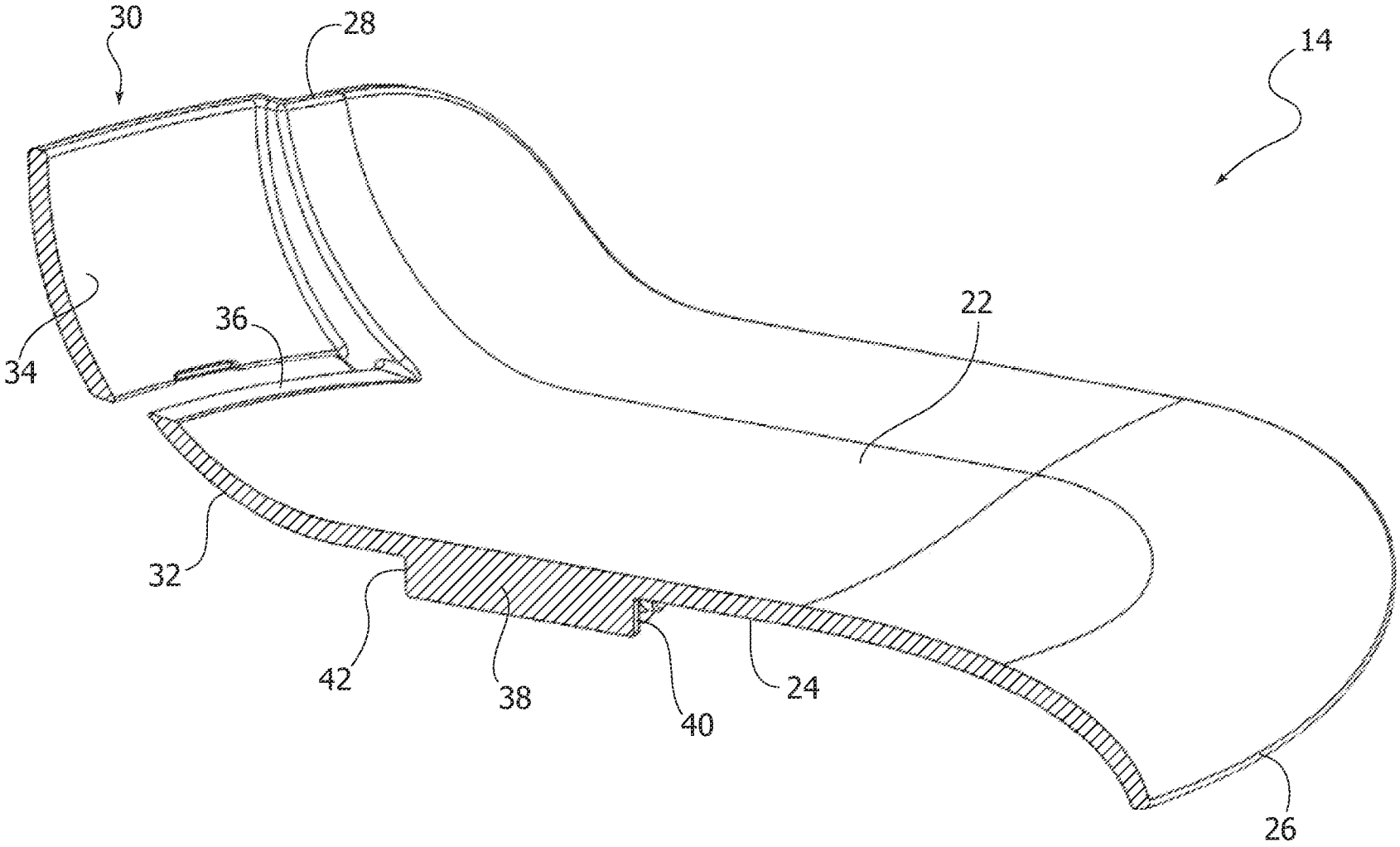
FIG. 3 is a perspective view in cross-section along the line III-III of FIG. 2.

With reference to FIGS. 2 and 3, the seat 14 has an upper surface 22, a lower surface 24, a front edge 26 and a rear edge 28. The seat 14 comprises a guide portion 30, preferably formed integrally with the shaped panel forming the seat 14. The guide portion 30 comprises a first guide surface 32 (FIG. 3) and a second guide surface 34. The guide surfaces 32, 34 are cylindrical surfaces having a common transverse axis. A through opening 36 is formed between the first guide surface 32 and the second guide surface 34. With reference to FIG. 3, the seat 14 comprises a stop protrusion 38 protruding from the lower surface 24, and having two stop surfaces 40, 42 whose function will become clear hereinafter.

Figure 4:
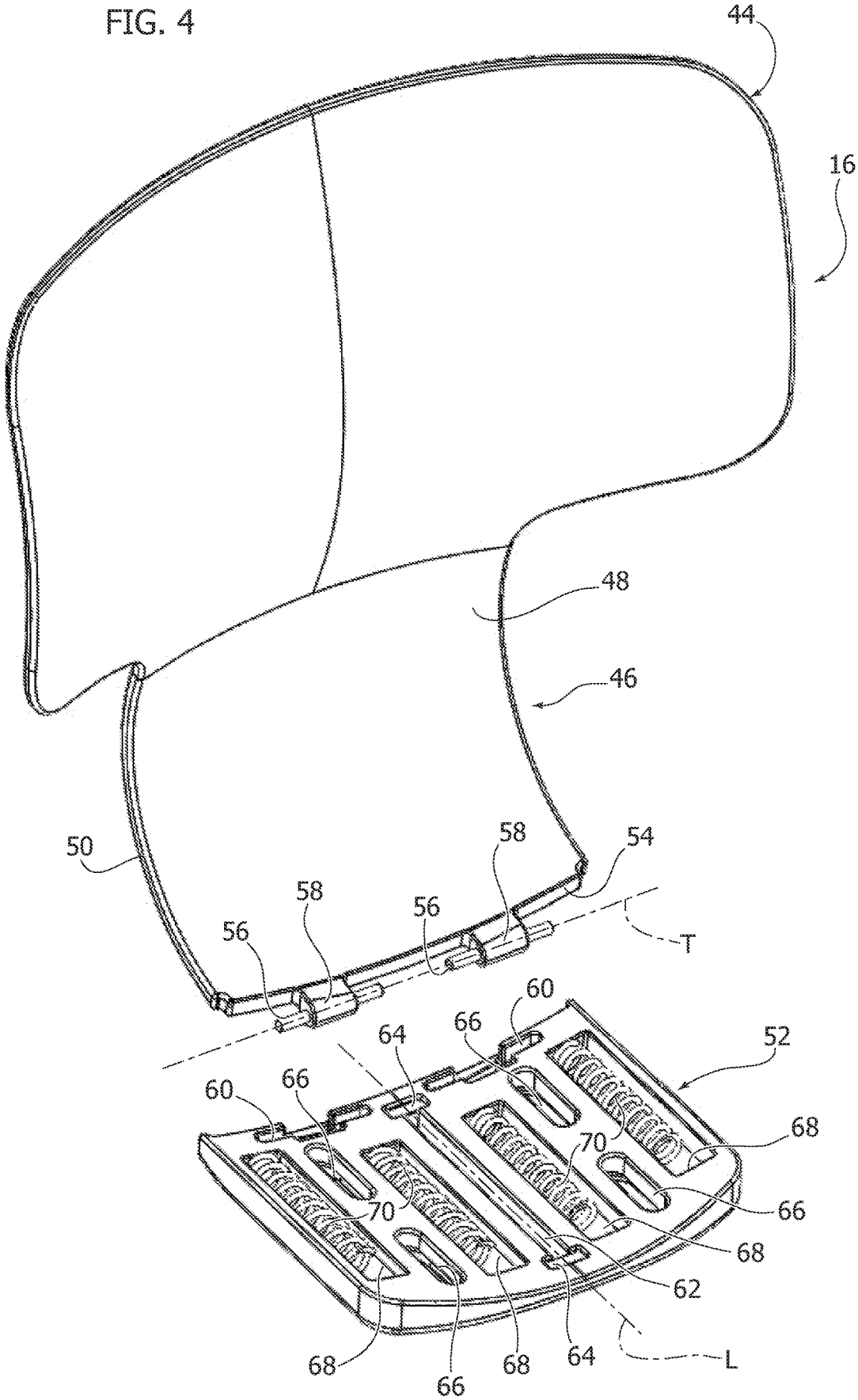
FIG. 4 is a perspective view of the part indicated by the arrow IV in FIG. 1.

With reference to FIG. 4, the backrest 16 comprises a resting portion 44 against which the user's back rests during use, and a connecting portion 46 which connects the backrest 16 to the seat 14. The resting portion 44 and the connecting portion 46 can be integrally formed in a single shaped panel of plastic material, for example, injection molded. The connecting portion 46 has a front surface 48 and a rear surface 50 both having a cylindrical shape with the same transverse axis. The front surface 48 and the rear surface 50 of the connecting portion 46 have the same transverse axis as the first and second guide surfaces 32, 34 of the seat 14.

Again with reference to FIG. 4, the chair 10 comprises a movable element 52 articulated to a lower edge 54 of the connecting portion 46 about a transversal axis T. The movable element 52 may be formed by a body of injection-molded plastic material. The articulation between the movable element 52 and the connecting portion 46 may be obtained by means of a pair of pins 56 aligned along the transversal axis T and carried by respective protuberances 58 protruding from the lower edge 54 of the connecting portion 46. The pins 56 may be inserted into respective seats 60 formed along a rear edge of the movable element 52.

The movable element 52 has a longitudinal groove 62 elongated along a longitudinal axis L orthogonal to the transverse axis T. The movable element 52 may comprise two elastomeric pads 64 located at the front and rear ends of the longitudinal groove 62.

The movable element 52 comprises a plurality of through grooves 66 elongated in a direction parallel to the longitudinal axis L. The movable element 52 further comprises a plurality of recesses 68 elongated in directions parallel to the longitudinal axis L within which respective elastic elements 70 are housed formed, for example, by coil springs.

Figure 5:
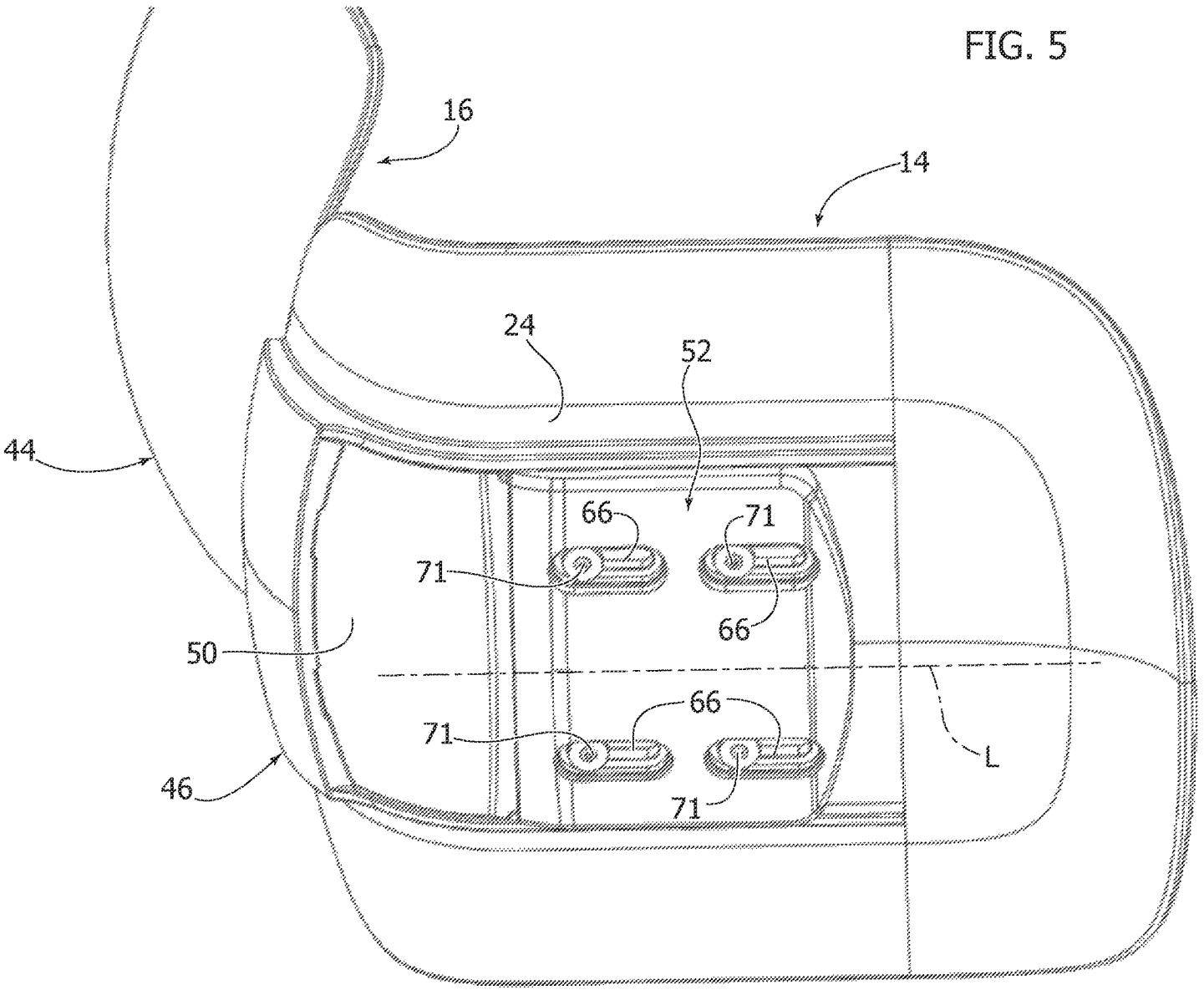
FIG. 5 is a perspective view from below according to the arrow V of FIG. 1, FIGS. 6 and 7 are cross-sections along the line VI-VI of FIG. 1, respectively, in the rest position and in the position of maximum backward tilt of the backrest.

With reference to FIG. 5, the movable element 52 is located below the lower surface 24 of the seat 14 and is connected to the seat 14 so that it can move along the longitudinal axis L between a forward position and a retracted position, and vice versa. The movable element 52 may be connected to the seat 14 by means of a plurality of screws 71 which extend through the respective through grooves 66. The screws 71 connect the movable element 52 to the seat 14 leaving the movable element 52 free to move along the straight direction L.

With reference to FIGS. 6-9, the connecting portion 46 of the seat 16 is slidably inserted between the first guide surface 32 and the second guide surface 34 of the seat 14. The connecting portion 46 extends through the opening 36 formed between the first guide surface 32 and the second guide surface 34. The stop protrusion 38 that protrudes from the lower surface 24 of the seat 14 is inserted into the longitudinal groove 62 of the movable element 52. The stop protrusion 38 has a length in the longitudinal direction L less than the length in the same direction of the longitudinal groove 62 of the movable element 52. The coil springs 70 housed in the recesses 52 of the movable element 52 have respective rear ends that rest against a surface of the respective recess 62 and respective front ends that rest against respective protrusions 72 which protrude from the lower surface 24 of the seat 14.

Figure 6:
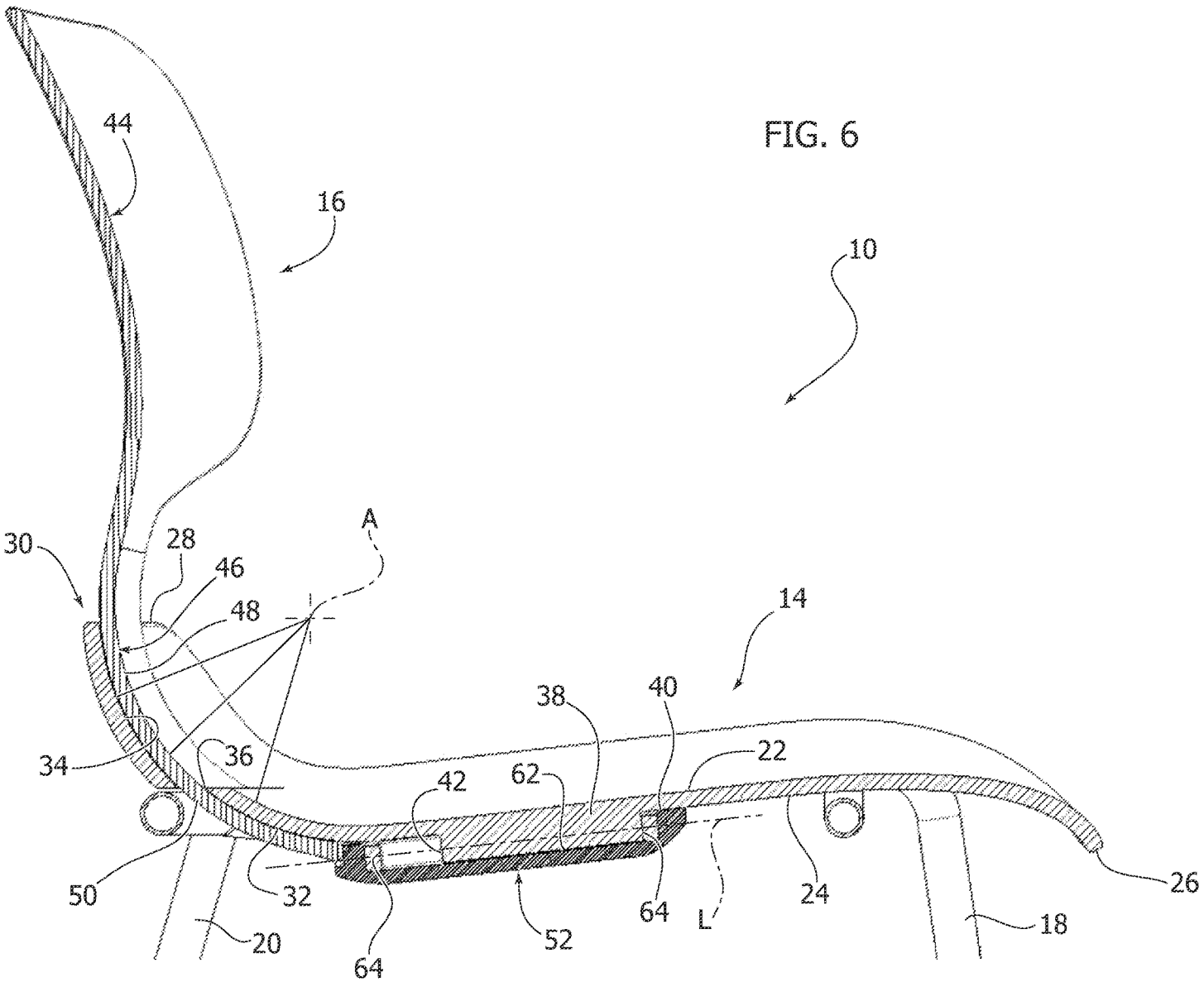
Figure 8:
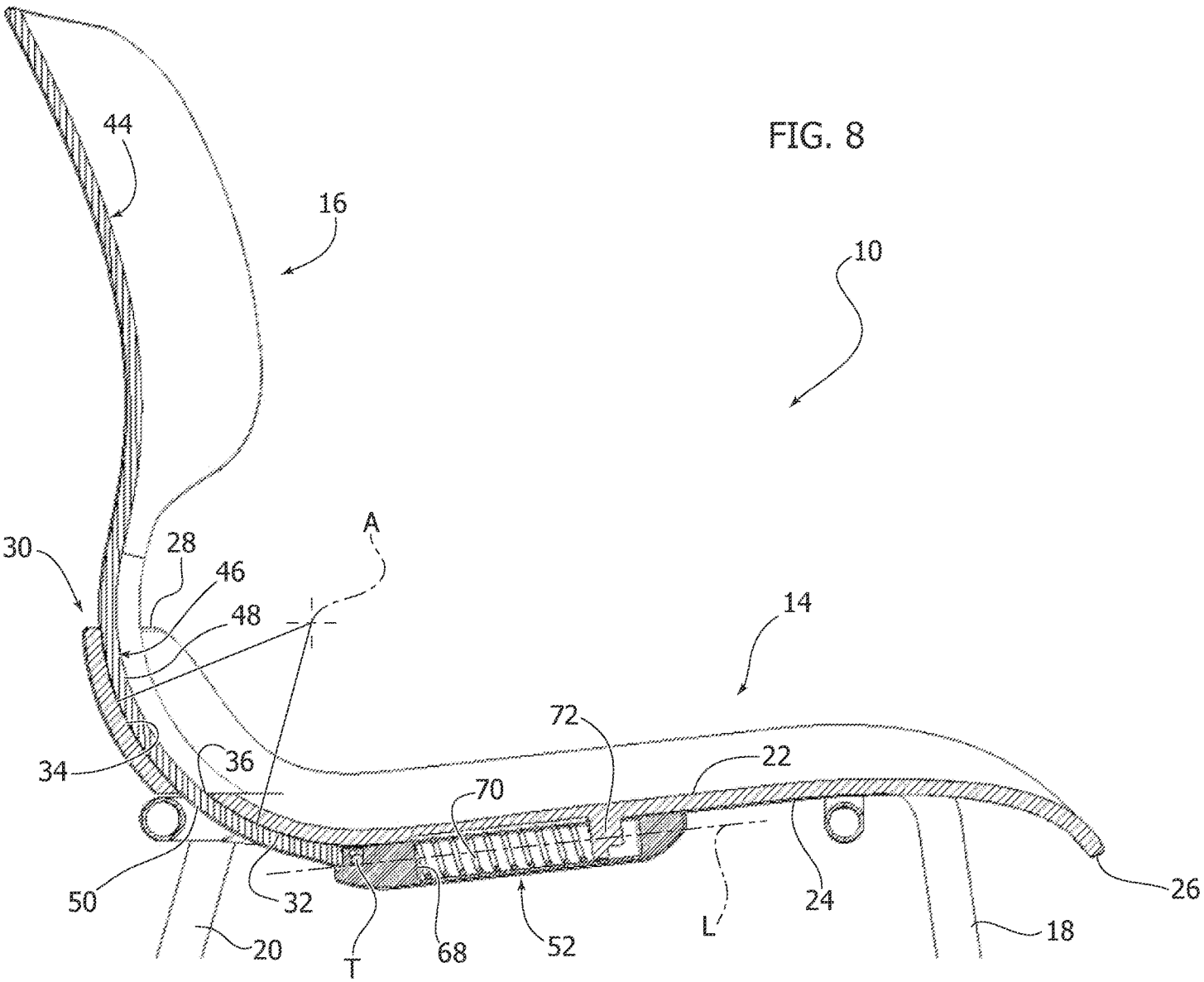
FIGS. 8 and 9 are cross-sections along the line VII-VII of FIG. 1, respectively, in the rest position and in the position of maximum backward tilt of the backrest.

With reference to FIGS. 6 and 8, in the rest configuration of the chair 10, the springs 70 push the movable element 52 towards the retracted position and the movable element 52 holds the seat 16 in the rest position. As illustrated in FIG. 6, the front end of the longitudinal groove 62 of the movable element 52 abuts against the front end 40 of the stop protrusion 38 of the seat 14 and defines a stop position of the movable element 52 corresponding to the rest position of the backrest 16.

Figure 7:
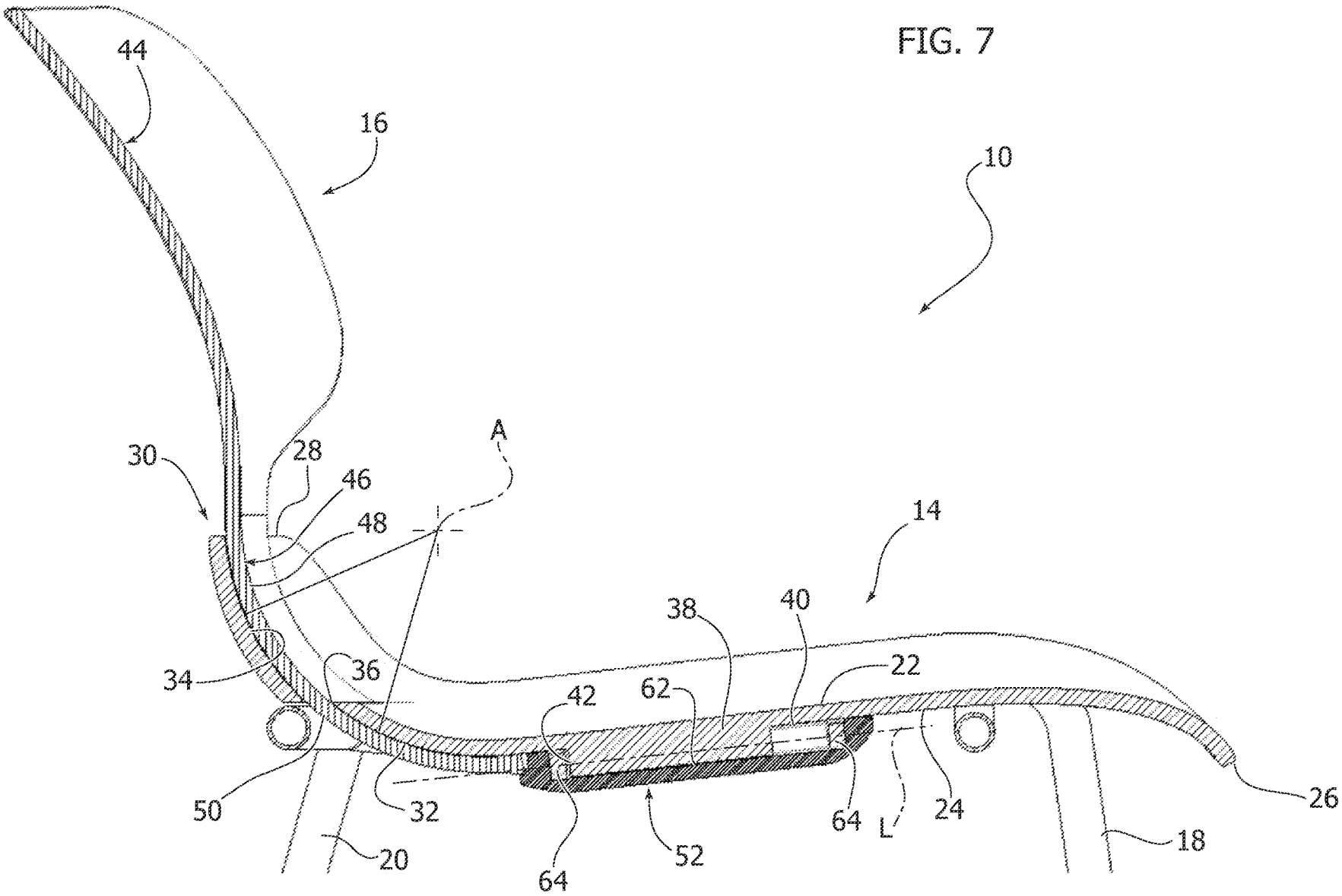
Figure 9:
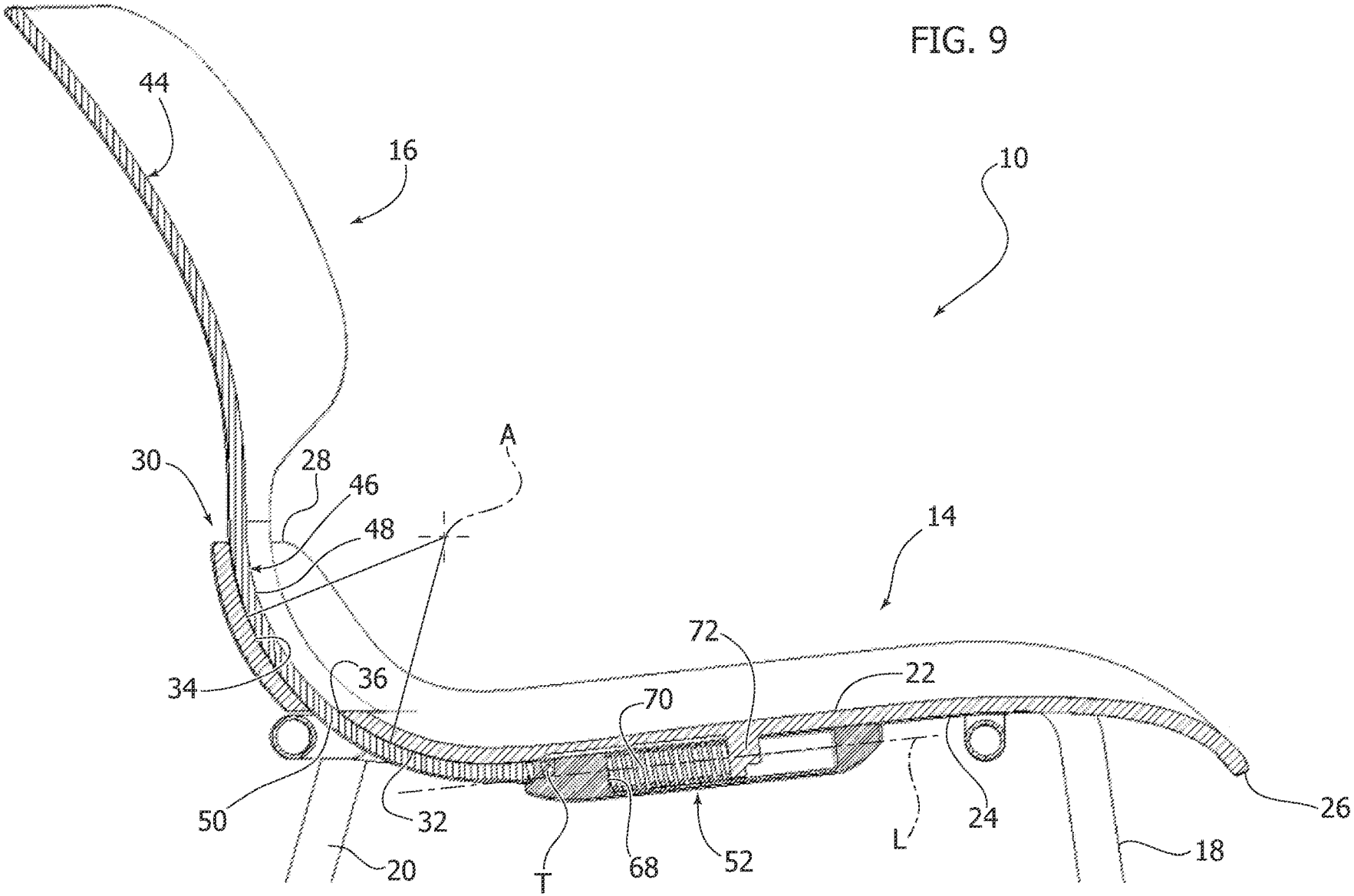

With reference to FIGS. 7 and 9, when the user rests his back against the backrest 16, the backrest 16 tilts backwards with respect to the rest position. The backward tilting movement of the backrest 16 is allowed by the sliding of the cylindrical surfaces 48 and 50 of the connecting portion 36 in contact with the corresponding cylindrical surfaces 32 and 34 of the seat 14. To facilitate sliding, these surfaces may be provided with coatings or inserts of low friction coefficient material (for example Teflon). During the backward tilting movement of the backrest 16, the movable element 52 moves forward and compresses the springs 70 as illustrated in FIG. 9. In this way, when the backward thrust applied by the user ceases, the springs 70 expand and return the backrest 16 to the rest position. The springs 70 apply an elastic force to the user's back in the rearward inclined position of the backrest 16.

As illustrated in FIG. 7, in the position of maximum backward tilt of the backrest 16, the rear end of the longitudinal groove 62 of the movable element 52 abuts against the rear end 42 of the stop protrusion 38 of the seat 14, and defines a stop position of the movable element 52 corresponding to the position of maximum backward tilt of the backrest 16.

With reference to FIGS. 6-9, the cylindrical surfaces 48, 50 and 32, 34 that guide the tilting movement of the backrest 16 have the same transversal axis A, which constitutes an axis around which the backrest 16 rotates during the backward tilting movement. The cylindrical surfaces 48, 50, 32, 34 may be sized so that the transversal axis A is positioned at the user's hips so as to avoid sliding between the resting surface of the backrest 16 and the user's back during the backward tilting movement.

The backward tilting mechanism of the backrest 16 according to the present invention makes it possible to create a particularly simple and light chair since the elements that guide the tilting movement of the seat are integrated with the seat 14 and with the backrest 16. The chair according to the present invention is comfortable for the user as it eliminates or considerably reduces the relative movements between the backrest and the user's back during the backward tilting movement. The solution according to the present invention also makes it possible to use a large number of elastic elements 70 which provide a strong reaction force that opposes the backward tilting movement of the backrest and that effectively supports the backward thrust applied by the back of the user.

Of course, without prejudice to the principle of the invention, the details of construction and the embodiments can be widely varied with respect to those described and illustrated, without thereby departing from the scope of the invention as defined by the claims that follow.

The invention claimed is:

1. A chair comprising:

a base structure, a seat carried by the base structure, and a backrest movable relative to the seat between a rest position and a rearward inclined position, wherein the backrest has a connecting portion having a front surface and a rear surface, wherein the seat has first and second guide surfaces which guide, respectively, the front surface and the rear surface of said connecting portion of the backrest, and wherein the front surface and the rear surface and said first and second guide surfaces are cylindrical surfaces having a common transverse axis.

2. The chair of claim 1, wherein said connecting portion is integrally formed with a resting portion of the backrest.

3. The chair of claim 1, wherein said first and second guide surfaces are integrally formed with the seat.

4. The chair of claim 1, wherein said connecting portion is movable through an opening formed between said first and second guide surfaces.

5. The chair of claim 1, comprising a movable element articulated to a lower edge of the connecting portion of the backrest, wherein said movable element is connected to the seat and is movable with respect to the seat along a longitudinal axis between a retracted position and a forward position corresponding, respectively, to the rest position and to the rearward inclined position of the backrest.

6. The chair of claim 5, wherein the movable element and the seat have respective stops, which cooperate with each other to define stroke-end positions of the backrest in the rest position and in a maximum rearward inclined position.

7. The chair of claim 6, wherein the seat has a stop protrusion protruding from a lower surface of the seat, which is inserted into a groove of the movable element.

8. The chair of claim 5, wherein the movable element has a plurality of recesses within which respective elastic elements are housed, which elastically push the movable element towards said retracted position.

9. A chair comprising:

a base structure, a seat carried by the base structure, a backrest movable relative to the seat between a rest position and a rearward inclined position, wherein the backrest has a connecting portion having a front surface and a rear surface, and a movable element articulated to a lower edge of the connecting portion of the backrest, wherein said movable element is connected to the seat and is movable with respect to the seat along a longitudinal axis between a retracted position and a forward position corresponding, respectively, to the rest position and to the rearward inclined position of the backrest, and wherein the movable element has a plurality of through grooves engaged by respective screws, which connect the movable element to the seat leaving the movable element free to move along a longitudinal straight direction of the longitudinal axis, and wherein the seat has first and second guide surfaces which guide, respectively, the front surface and the rear surface of said connecting portion of the backrest.

* * * * *